US005313359A

United States Patent [19]

Imagawa et al.

[11] Patent Number: 5,313,359

[45] Date of Patent: May 17, 1994

[54] EXCESSIVE CURRENT PREVENTING DEVICE FOR THE CONTACT CHARGING OF A PHOTOSENSITIVE LAYER

[75] Inventors: Shinji Imagawa, Yao; Koichi Inui, Higashiosaka, both of Japan

[73] Assignee: Sharp Kabushiki Kaisha, Japan

[21] Appl. No.: 890,673

[22] Filed: May 29, 1992

[30] Foreign Application Priority Data

May 30, 1991 [JP] Japan ..... 3-127690

[51] Int. Cl.[5] ..... G03G 15/02

[52] U.S. Cl. ..... 361/225; 355/210; 355/219; 361/221

[58] Field of Search ..... 355/210, 211, 212, 213, 355/219; 361/221, 220, 225, 58, 111

[56] References Cited

FOREIGN PATENT DOCUMENTS

| | | | |
|---|---|---|---|
| 113079 | 5/1986 | Japan . | |
| 24264 | 1/1989 | Japan | 355/219 |
| 1-34426 | 5/1989 | Japan | 355/219 |
| 1-191161 | 8/1989 | Japan . | |

*Primary Examiner*—Benjamin R. Fuller
*Assistant Examiner*—J. E. Barlow, Jr.
*Attorney, Agent, or Firm*—David G. Conlin; Peter F. Corless

[57] ABSTRACT

A contact charger includes a photoreceptor having a photosensitive layer formed on a surface of an electrically conductive drum base and a fixed coil connected to the drum base and ground. The contact charger charges the photosensitive layer by making a charge roller in contact with the photosensitive layer while being applied thereto DC voltage from a power supply. With this arrangement, in the case where a pin hole exists on the photosensitive layer, there may have a continuity between the charge roller and the drum base which may results in a sudden increase in current flowing between the drum base and ground. When this happens, however, since self-induced electromotive force, having a direction opposite to the electromotive force of the power supply, is generated by the fixed coil in response to a sudden increase in current, excessive current will not flow between the drum base and ground, thereby eliminating the possibility of a large drop in voltage of the power supply. As a result, the contact charger is always capable of appropriately charging the surface of the photosensitive layer even in the case where a defect such as a pin hole exists on the photosensitive layer.

24 Claims, 3 Drawing Sheets

EXCESSIVE CURRENT PREVENTING DEVICE FOR THE CONTACT CHARGING OF A PHOTOSENSITIVE LAYER

FIELD OF THE INVENTION

The present invention relates to a contact charger for charging a surface of a photoreceptor by applying thereon DC voltage through a charging unit in contact therewith, the photoreceptor being provided in the electrophotographic printing machine which forms images by an electrophotography.

BACKGROUND OF THE INVENTION

An electrophotographic printing machine forms images by the electrophotography as described below. First, a photosensitive layer formed on the surface of the photoreceptor is uniformly charged with a single polarity. Then, an electrostatic latent image is formed on the surface of the photoreceptor through the process of exposure. Further, fine colored particles (toner) charged by applying thereon a charge having a polarity opposite to the charge on the photosensitive layer are made to adhere the electrostatic latent image by electrostatic force, thereby forming images.

In the electrophotographic printing machine thus described, conventionally a corona discharger has been used as a charger for uniformly charging with a single polarity the photosensitive layer formed on the surface of the photoreceptor. However, in the case of adopting the corona discharger, an application of high voltage is required for a wire electrode when charging the photosensitive layer. This presents the problem since a power supply for applying voltage to the wire electrode becomes larger in size. Moreover, with the corona discharger, an erosion of the components of the machine and the deterioration of the surface of the photoreceptor are likely to occur due to ozone produced in the process of corona-discharging the photosensitive layer. This results in the problem by making unclear and fuzzy the images, or by adversely affecting the human body, etc.

In order to counteract the above-mentioned problems, the contact charger provided with an electrically conductive contacting component in contact with the photosensitive layer formed on the surface of the photoreceptor has been recently proposed. With this contact charger, the photosensitive layer formed on the surface of the photoreceptor is charged through the contacting component by applying DC voltage to the contacting component.

For the contacting component designed for the contact charger, for example, a charge roller 41 shown in FIG. 5 may be used. The charge roller 41 is arranged such that an electrically conductive elastic layer made of a flexible material such as a silicone rubber including a carbon is formed on a surface of an electrically conductive cylindrical roller base. The charge roller 41 is freely rotative about an axis parallel to a rotation axis of a photoreceptor 42. Further, the charge roller 41 is in contact with the surface of the photoreceptor 42 with a predetermined nip width. The charge roller 41 rotates in conjunction with the rotation of the photoreceptor 42.

A power supply (not shown) being connected to the roller base of the charge roller 41 applies DC voltage to the surface of the photoreceptor 42 through the charge roller 41.

Here, the photoreceptor 42 is designed so as to have the photosensitive layer on the surface thereof having a property as an insulator when it is not exposed, on the other hand, having an electric property which makes the exposed portion thereof electrically conductive when it is exposed. The base of photoreceptor 42 is made of an electrically conductive material and connected to ground so that a charge on the photosensitive layer is released to ground through the process of exposure.

However, the arrangement of the discussed contact charger results in the following problems when a defect exists such as a pin hole on the photosensitive layer formed on the surface of the photoreceptor 42 due to a deterioration thereof.

Namely, at the portion where the defect exists, there may have a continuity between the surface of the charge roller 41 and the base of the photoreceptor 42 as an electric conductor since the charge roller 41 and the photoreceptor 42 are in direct contact with one another. This means that excessive current flows between the charge roller 41 and the base of the photoreceptor 42, and thus voltage of a power supply suddenly drops. As a result, an improper charge occurs in an axis direction at the portion where the defect exists (drop in the charged potential) on the photosensitive layer formed on the surface of the photoreceptor 42, thereby presenting a problem of an irregular image.

In order to counteract the problem of an improper charge due to a leakage of current from the portion where the defect exists on the photosensitive layer, there is an idea of increasing a resistance of the contacting component. However, if the resistance of the contacting component increases, it is difficult to apply sufficient charges to the entire surface of the photoreceptor.

SUMMARY OF THE INVENTION

An object of the present invention is to provide a contact charger for appropriately charging a surface of a photosensitive layer formed on a photoreceptor.

In order to achieve the above object, a contact charger in accordance with the present invention for uniformly charging a photosensitive layer having a photoconductivity formed on a surface of an electrically conductive base of a photoreceptor, is characterized in comprising: charging means for charging the photosensitive layer, the charging means being in contact therewith; power supply means for applying DC voltage to the charging means; and induced electromotive force generation means having an inductance, the induced electromotive force generation means being connected to the base and ground.

With this arrangement, voltage is applied from a power supply to the charging means in contact with the photosensitive layer of the photoreceptor. Then, a charge is transferred to the photosensitive layer through the charging means, thereby uniformly charging the photosensitive layer with a single polarity. In this way, by moving a portion in contact with the charging means of the photosensitive layer of the photoreceptor, the predetermined area of the photosensitive layer can be uniformly charged.

Normally, a portion of the photosensitive layer in contact with the charging means has a property as an insulator. Thus, an electric resistance of the photosensitive layer becomes very high, and thus substantially no current flows between the base of the photoreceptor and ground.

With the arrangement of the discussed contact charger, there may have a continuity between the surface of the charge roller and the base of the photoreceptor due to a deterioration of the photosensitive layer since the charge roller and the photoreceptor are in direct contact with one another. In this case, an electric resistance of the photoreceptor becomes extremely low, and thus a sudden increase is likely to occur in current flowing between the base of the photoreceptor and ground. This happens, for example, in the case where a defect exists such as a pin hole on the photosensitive layer of the photoreceptor.

However, this problem can be prevented through the following process. First, with a sudden change in the amount of current, electromotive force is generated by induced electromotive force generation means. Here, the electromotive force generated by the induction function has a direction opposite to the electromotive force of the power supply. For this reason, a large amount of current will not flow between the base and ground, thereby eliminating the possibility of a sudden drop in voltage of the power supply.

As described, the discussed contact charger is capable of appropriately charging the photosensitive layer of the photoreceptor even in the case where a defect such as a pin hole exists on the photoreceptor.

In order to achieve the above object, another contact charger in accordance with the present invention for uniformly charging a photosensitive layer having a photoconductivity formed on a surface of an electrically conductive base of a photoreceptor is characterized in comprising: charging means for charging the photosensitive layer, the charging means being in contact therewith; power supply means for applying DC voltage to the charging means; current detection means for detecting current flowing between the base and ground; electric resistance change means for increasing an electric resistance between the base and ground for a predetermined time upon more than a predetermined amount of current is detected by the current detection means.

Normally, a portion in contact with the charging means of the photosensitive layer has a property as an insulator as in the case of the previously discussed arrangement. Thus, an electric resistance of the photosensitive layer is very high, and substantially no current flows between the base and ground.

However, in the case where a defect exists such as a pin hole on the photosensitive layer of the photoreceptor, there may have a continuity between the surface of the charging means and the base of the photoreceptor at the portion where the defect exists, resulting in excessive current flowing between the base and ground.

When this happens, the excessive current flowing between the base and ground is detected by the current detection means. Then, the electric resistance change means increases an electric resistance between the base and ground, and thus excessive current will not flow continuously in the photoreceptor, thereby eliminating the possibility of a continuous large drop in voltage of the power supply.

As described, the contact charger in accordance with the present invention is capable of appropriately charging the photosensitive layer of the photoreceptor even in the case where a pin hole or a larger defect exists on the photosensitive layer of the photoreceptor.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a diagram showing an essential part of a contact charger of the first embodiment in accordance with the present invention.

FIG. 2 is a diagram showing an equivalent circuit in accordance with the contact charger of FIG. 1.

FIG. 3 is a block diagram showing an essential part of the contact charger of the second embodiment in accordance with the present invention.

FIG. 4 is a diagram showing an essential part of a resistance switching circuit in accordance with the contact charger of FIG. 3.

DETAILED DESCRIPTION OF THE EMBODIMENTS

Figure 1:
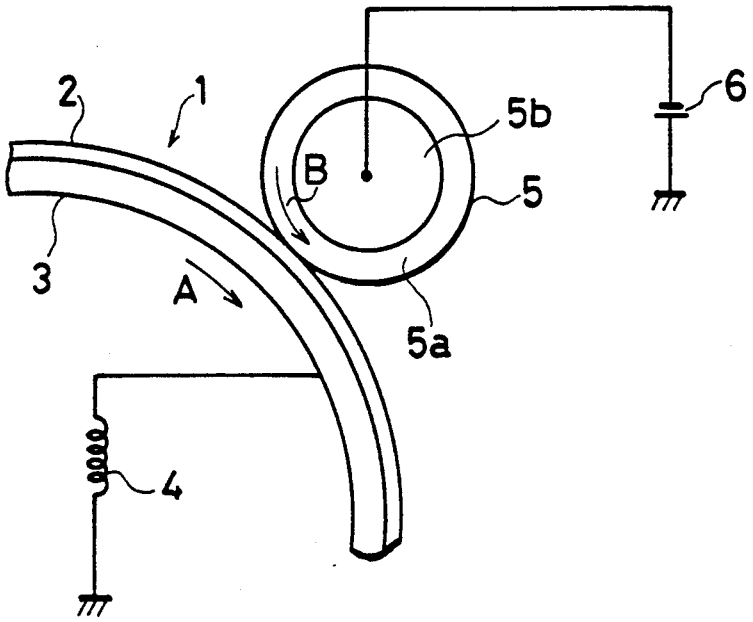
FIGS. 1 through 4 describe the present invention in detail.

A first embodiment illustrating the present invention will be discussed hereinbelow with reference to FIGS. 1 and 2.

A contact charger in accordance with the present embodiment is designed for an electrophotographic printing machine which forms images by an electrophotography. As shown in FIG. 1, the electrophotographic printing machine includes a photoreceptor 1 having a photosensitive layer 2 formed on a peripheral surface of the cylindrical drum base 3. The photoreceptor 1 is driven by drive means (not shown) in the direction of arrow A in the figure.

The photosensitive layer 2 formed on the surface of the photoreceptor 1 has a property as an insulator when it is not exposed. On the other hand, the photosensitive layer 2 has an electric property which makes an exposed portion thereof electrically conductive when it is exposed. As the photosensitive layer 2, for example, the separated-function type one having a double-layered structure of a carrier generation layer (CGL) and a carrier transport layer (CTL) may be adopted. The CGL is provided for generating an optical carrier by an projection of light beam. The CTL is provided for transporting the optical carrier. However, it should be noted that the structure of the photosensitive layer 2 is not necessarily limited to this type, for example, a single layered one may be used as well.

The drum base 3 is made of an electrically conductive material such as aluminum and connected to ground with a fixed coil 4 (excessive current protection means and induced electromotive force generation means) having a predetermined inductance L in between so that charges on the exposed portion of the photosensitive layer 2 are likely to be released.

The photosensitive layer 2 of the photoreceptor 1 is in contact with a charge roller 5 (charging means) which is rotatably provided. Here, the charge roller 5 rotates about an axis substantially parallel to the rotation axis of the photoreceptor 1. The charge roller 5 is entirely in contact with the photoconductor 1 in an axis direction.

The charge roller 5 is designed such that an electrically conductive elastic layer **5*a* is formed on a surface of a cylindrical roller base 5*b* made of an electrically conductive material such as a metal. Further, the charge roller 5 is in contact with the surface of the photoreceptor 1 with a predetermined nip width. The charge roller 5 rotates in the direction of arrow B in conjunction with a rotation of the photoreceptor 1 in the direction of arrow A. Here, the electrically conductive elastic layer 5***a* is preferably made of a silicone rubber including a carbon.

A negative terminal of a power supply 6 is connected to the roller base 5*b* of the charge roller 5. On the other hand, a positive terminal of the power supply 6 is connected to ground. DC voltage from the power supply 6 is applied through the charge roller 5 to the photosensitive layer 2 formed on the surface of the photoreceptor 1. As a result, the photosensitive layer 2 is negatively charged. Similarly, in the case of positively charging the photosensitive layer of the photoreceptor, the positive terminal of the power supply is connected to the charge roller, and the negative terminal is connected to ground.

Along the circumference of the photoreceptor 1, an exposure unit, developer unit, transfer unit, cleaner, and eraser are provided in such sequential order in a rotating direction of arrow A taking the position of the charge roller 5 as a reference point.

The following description will discuss the image forming process of the electrophotographic printing machine.

First, the photosensitive layer 2 formed on the photoreceptor 1 is uniformly charged in a dark place by the contact charger. The charging operation of the contact charger will be described in detail later.

Next, the uniformly charged photosensitive layer 2 is illuminated except the portion whereon an image is formed. As a result, an illuminated portion of the photosensitive layer 2 becomes electrically conductive. Further, charges on the illuminated portion are released to ground through the drum base 3 and the coil 4. As a result, an electrostatic image is formed with residual charges remaining on an image portion of the photosensitive layer 2.

Then, the developer unit makes the fine colored particles of toner adhere to the electrostatic latent image. Here, the fine colored particles are charged by applying thereon a charge having a polarity opposite to the polarity of the electrostatic latent image formed on the surface of the photoreceptor 1.

Thereafter, the toner powder image is transferred to a copy paper sheet fed by a document feeder (not shown). Further, the transfer unit charges the back surface of the copy paper sheet, thereby transferring the toner powder image to the copy paper sheet using the electrostatic force. After the copy paper sheet is separated from the photoreceptor 1., a fuser (not shown) makes the toner powder image permanent on the copy paper sheet by applying heat and pressure to the toner powder image.

The cleaner removes the residual toner remaining on the surface of the photoreceptor 1 after the transfer. Similarly, the charge is electrostatically eliminated by the eraser.

The electrophotographic printing machine repeats the above process, i.e., from the charging by the contact charger to the electrostatical elimination done by the eraser, thereby successively forming images.

In the discussed electrophotographic printing machine, a normal development has been employed wherein the electrostatic latent image is formed with residual charges on the image portion by illuminating a non-image portion of the photosensitive layer 2 (a so-called positive latent image), and the toner is made to adhere to the photosensitive layer 2, the toner being charged by applying thereon a charge having a polarity opposite to the polarity of the electrostatic latent image. However, other methods may be equally adopted such as a reversal development wherein the electrostatic latent image is formed with a discharged image portion by illuminating the image portion of the photosensitive layer 2 (a so-called negative latent image), and the toner charged by applying a charge having the same polarity as the charge of the electrostatic latent image adheres to the photosensitive layer 2.

The following description will discuss the charging process of the contact charger in detail.

The photoreceptor 1 rotates in the direction of arrow A by drive means at a predetermined speed. The charge roller 5 is in contact with the photosensitive layer 2 of the photoreceptor 1 with a predetermined nip width and rotates in the direction of arrow B in conjunction with the rotation of the photoreceptor 1. DC voltage is applied from the power supply 6 to the charge roller 5. Further, the charge is transferred onto the photosensitive layer 2 of the photoreceptor 1 through the charge roller 5, thereby uniformly charging the predetermined area thereof. More concretely, the photosensitive layer 2 is charged through triboelectric charging by a friction between the photosensitive layer 2 and the charge roller 5, charge injection charging wherein the charge are directly transferred from the charge roller 5 to the photosensitive layer 2 and gaseous discharging. The gaseous discharging takes place in a microscopic space between the charge roller 5 and the photosensitive layer 2 in a vicinity of the contact area.

Figure 2:
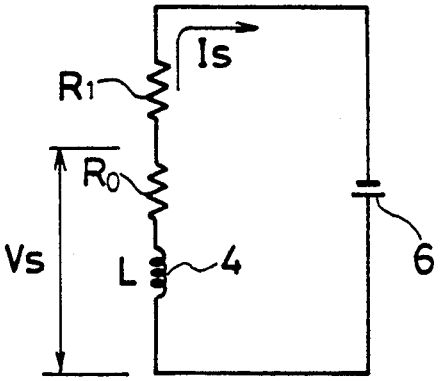

FIG. 2 shows an equivalent circuit of the contact charger wherein $R_1$ and $R_0$ respectively represent an electrical resistance of the charge roller and an electric resistance of the photoreceptor 1. Here, the charge roller 5 is provided in a dark place, and a portion of the photosensitive layer 2 in contact with the charge roller 5 has a property as an insulator. For this reason, the electric resistance $R_0$ of the photoreceptor 1 is extremely high and only a small amount of current $I_s$ flows through the circuit.

In addition, in the case where a defect exists such as a pin hole on the photosensitive layer 2 of the photoreceptor 1, since the charge roller 5 and the photoreceptor 1 are in direct contact with one another, there may have a continuity between the surface of the charge roller 5 and the drum base 3 at the portion where the defect exists. This means that directly after the pin hole appears on the photosensitive layer 2 of the photoreceptor 1 rotating at a predetermined speed contacts the charge roller 5, the electric resistance $R_0$ of the photoreceptor 1 drops, resulting in the problem of a sudden increase in current Is flowing through the circuit.

However, this problem can be prevented through the following process. First, with a sudden change in the amount of the current Is flowing through the circuit, the electromotive force is generated by a self-induction function of a coil 4. Here, the electromotive force generated by the self-induction function has a direction opposite to the electromotive force of the power supply 6. For this reason, excessive current will not flow through the circuit, thereby eliminating the possibility of a sudden drop in voltage of the power supply 6.

Thus, with the contact charger of the present embodiment, a substantially constant surface voltage $V_s$ of the photoreceptor 1 can be maintained even in the case where a defect exists such as a pin hole on the photosensitive layer 2 of the photoreceptor 1.

Although an explanation is given through the case where there is a continuity between the surface of the charge roller 5 and the drum base 3, the present invention is not necessarily limited to this particular case. For example, the present invention is also applicable to the case where a resistance in a portion of the photosensitive layer 2 is very low, and excessive current suddenly flows between the drum base 3 and ground, and thus induced electromotive force is generated, thereby eliminating the possibility of a drop in voltage of the power supply 6.

As described, the contact charger in accordance with the present embodiment is always capable of appropriately charging the surface of the photosensitive layer 2 of the photoreceptor 1.

In the discussed preferred embodiment, the charge roller 5 has been employed as a charging means. However, other types of charging means can be equally adopted. As a charging means other than the charge roller 5, a blush-shaped or blade-shaped one is preferably adopted.

In addition, the contact charger in the discussed preferred embodiment is designed for use in an electrophotographic printing machine. As a concrete example, it is preferably used in a photo-copying machine or a laser printer.

As described, the contact charger in accordance with the present embodiment for uniformly charging a photosensitive layer having a photoconductivity formed on a surface of an electrically conductive base of a photoreceptor is arranged so as to comprise: charging means for charging the photosensitive layer, the charging means being in contact therewith; power supply for applying DC voltage to the charging means; and induced electromotive force generation means having an inductance being connected to the base and ground.

With this arrangement, the possibility of a large drop in voltage of the power supply can be eliminated even in the case where a defect exists on the photosensitive layer due to a deterioration thereof, and thus there becomes a continuity between the surface of the charging means and the base of the photoreceptor, which may result in a sudden increase in current flowing between the base and ground. This is because the induced electromotive force generation means generates self-induced electromotive force having a direction opposite to the electromotive force of the power supply means when the sudden increase in current occurs, thereby eliminating the possibility of a sudden drop in voltage of the power supply means. Therefore, the contact charger in accordance with the present embodiment is capable of appropriately charging the surface of the photosensitive layer formed on the photoreceptor no matter whether or not a defect exists on the photosensitive layer of the photoreceptor.

Another example illustrating the present invention will be discussed hereinbelow with reference to FIGS. 3 and 4. Here, a photoreceptor 101 and a power supply 106 respectively have the same functions as the photoreceptor 1 and the power supply 6 in the previously discussed embodiment, thus the description thereof shall be omitted here.

As in the previously discussed embodiment, the charge roller 105 is designed such that an electrically conductive elastic layer (not shown) made of a flexible material is formed on a surface of a cylindrical roller base (not shown) made of an electrically conductive material such as a metal. Further, the charge roller 105 is in contact with the surface of the photoreceptor. 101 with a predetermined nip width. Here, the electrically conductive elastic layer is preferably made of a silicone rubber including a carbon.

Figure 3:
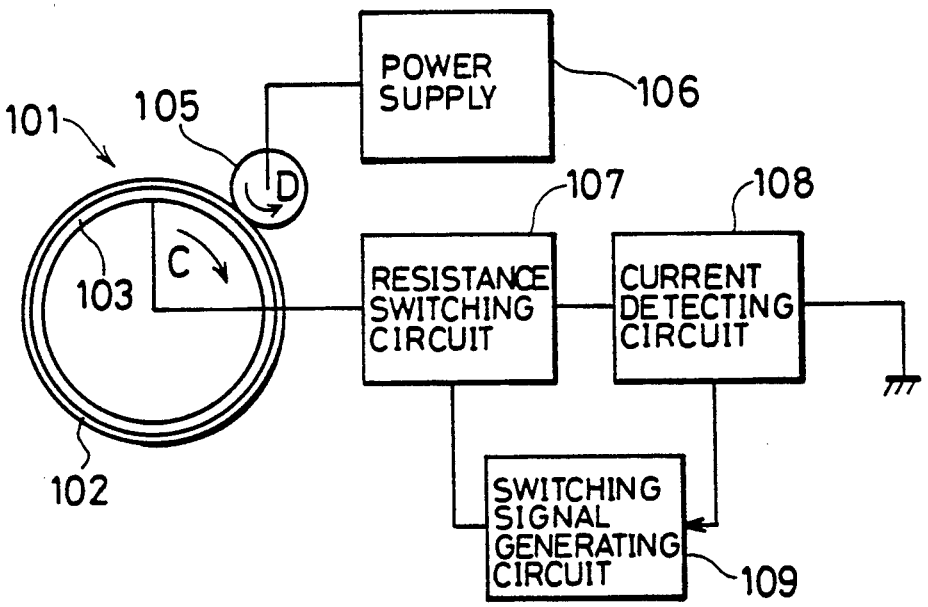

As shown in FIG. 3, a drum base 103 of the photoreceptor 101 is connected to ground with a resistance switching circuit 107 and a current detecting circuit 108 in between. The current detecting circuit 108 is provided for detecting current flowing between the drum base 103 and ground and sending a detecting signal to a switching signal generation circuit 109 (switching signal generation means) upon detecting more than a predetermined amount of current.

The switching signal generation circuit 109 outputs the switching signal to the resistance switching circuit 107 for a predetermined time upon being inputted the detecting signal from the current detecting circuit 108.

Figure 4:
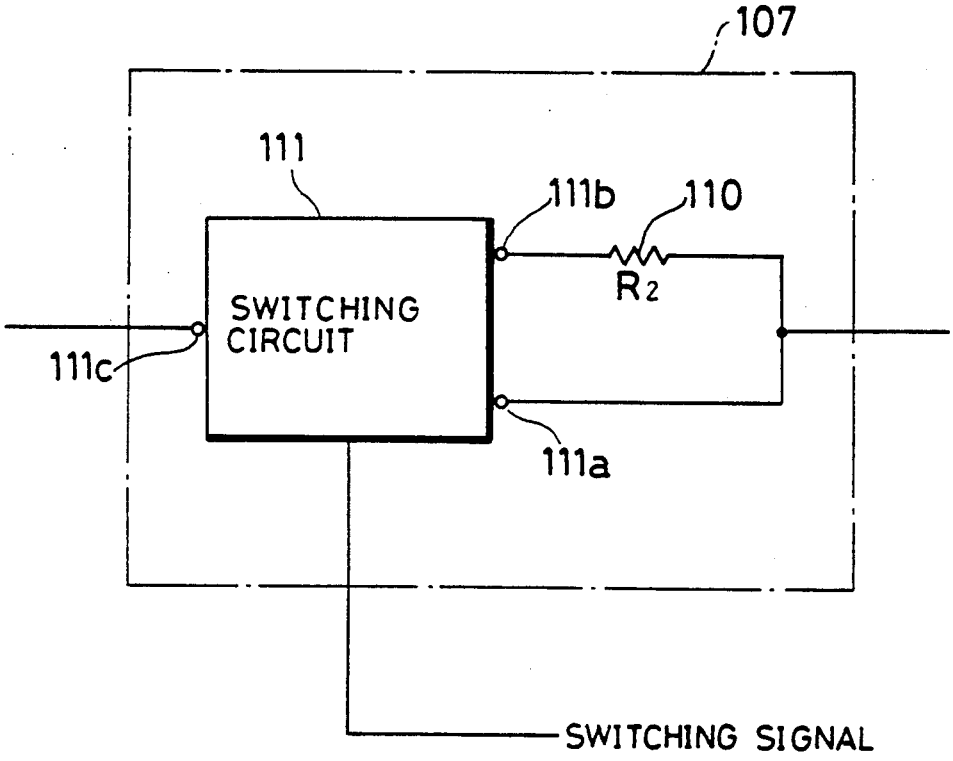
Figure 5:
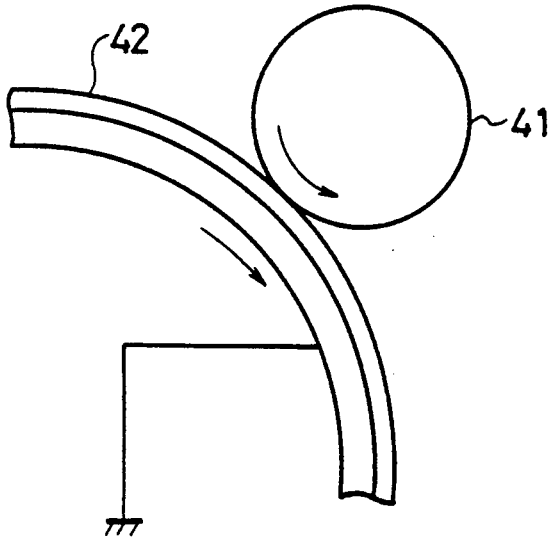
FIG. 5 PRIOR ART
FIG. 5 is a diagram showing an essential part of the conventional contact charger.

As shown in FIG. 4, the resistance switching circuit 107 includes a resistor 110 having a predetermined high electric resistance value $R_2$ and a switching circuit 111.

A common terminal 111*c* of the switching circuit 111 is connected to the drum base 103. Further, a contact point 111*a* (second contact point) of the switching circuit 111 is connected to the current detecting circuit 108. On the other hand, a contact point 111*b* (first contact point) is connected to the resistor 110. The resistor 110 is connected to ground with the current detecting circuit 108 in between. With this arrangement, when the common terminal 111*c* is connected to the contact point 111*a* in the switching circuit 111, the drum base 103 is connected to ground without having the resistor 110 in between. On the other hand, when the common terminal 111*c* is connected to the contact point 111*b*, the drum base 103 is connected to ground with the resistor 110 in between having a high electric resistance $R_2$.

The switching circuit 111 connects the common terminal 111*c* to the contact point 111*b* only while being inputted the switching signal from the switching signal generation circuit 109 and otherwise connect it to the contact point 111*a*.

The following is a detailed description of a charging operation of the contact charger.

Initially, the common terminal 111*c* of the switching circuit 111 is connected to the contact point 111*a*. In other words, the drum base 103 of the photoconductor 101 is connected to ground with the current detecting circuit 108 in between, and the resistor 110 is not connected to the drum base 103 of the photoreceptor 101.

As shown in FIG. 3, the photoreceptor 101 is driven by drive means (not shown) in the direction of arrow C at a predetermined speed. Further, the charge roller 105 is in contact with the photosensitive layer 102 of the photoreceptor 101 with a predetermined nip width. The charge roller 105 rotates in the direction of arrow D in conjunction with a rotation of the photoreceptor 101. Further, DC voltage is applied from the power supply 106 to the charge roller 105. Thus, the charge is transferred onto the photosensitive layer 102 of the photoreceptor 101 through the charge roller 105, thereby uniformly charging the photosensitive layer 102 with a single polarity.

With the above arrangement, normally since a portion of the photosensitive layer 102 in contact with the charge roller 105 serves as an insulator, substantially no current flows between the drum base 103 and ground.

On the other hand, in the case where a detect exists such as a pin hole on the photosensitive layer 102 due to a deterioration thereof, there becomes a continuity between the surface of the charge roller 105 and the drum base 103 when the pin hole on the photosensitive layer 102 of the photoreceptor 101 contacts the charge roller 105, the photoreceptor 101 being rotating at a predetermined speed. As a result, excessive current (short-circuit current) flows from the power supply 106 to the drum base 103, and this is to be detected by the current detecting circuit 108.

The current detecting circuit 108 also sends the detecting signal to the switching signal generation circuit 109. Further, the switching signal generation circuit 109 outputs the switching signal for a predetermined time to the switching circuit 111 of the resistance switching circuit 107 upon being inputted the detecting signal. The switching circuit 111 connects the common terminal 111*c* to the contact point 111*b* only while being inputted the switching signal.

With this arrangement, the drum base 103 is connected to ground with the resistor 110 having a high resistance value $R_2$ in between. As a result, excessive current will not continuously flow in the photoreceptor 101, thereby eliminating the possibility of a continuous large drop in voltage of the power supply 106.

As described, the contact charger in accordance with the present embodiment is capable of appropriately charging the photosensitive layer 102 of the photoreceptor 101 even in the case where a small defect such as a pin hole or a larger defect exists on the photosensitive layer 102 of the photoreceptor 101.

Although an explanation is given through the case where there is a continuity between the surface of the charge roller 105 and the drum base 103, the present invention is not necessarily limited to this particular case. For example, the present invention is also applicable to the case where a resistance in a certain portion of the photosensitive layer 102 becomes very low, and thus excessive current flows between the drum base 103 and ground. As in the case of the previously discussed embodiment, excessive current in the drum base 103 and ground is detected by the current detecting circuit 108. Then, the drum base 103 is connected to ground for a predetermined time with the resistor 110 in between having a high resistance value $R_2$, thereby eliminating the possibility of a large drop in voltage of the power supply 106.

As discussed, the contact charger in accordance with the present embodiment is always capable of appropriately charging the surface of the photosensitive layer 102 of the photoreceptor 101.

In the discussed preferred embodiment, the charge roller 105 has been employed as a charging means. However, other types of charging means may be equally adopted. As an example for charging means other than the charge roller 105, a blush-shaped or blade-shaped one is preferably adopted.

In addition, the contact charger in the discussed preferred embodiment is designed for use in an electrophotographic printing machine. As a concrete example, it is preferably used in a photo-copying machine or a laser printer.

As described, the contact charger in accordance with the present embodiment for uniformly charging a photosensitive layer having a photoconductivity formed on a surface of an electrically conductive base of a photoreceptor is arranged so as to comprise: charging means for charging the photosensitive layer, the charging means being in contact therewith; power supply for applying DC voltage to the charging means; current detection means for detecting current between the base and ground; switching signal generation means for outputting a switching signal only for a predetermined time upon more than a predetermined amount of current is detected by the current detection means; and resistance change means for increasing an electric resistance between the base and ground for a predetermined time upon more than a predetermined amount of current is detected by the current detection means.

With this arrangement, the possibility of a continuous large drop in voltage of the power supply can be eliminated even in the case where a defect exists on the photosensitive layer due to a deterioration thereof and thus there has a continuity or the like between the surface of the charging means and the base of the photoreceptor, which may result in an increase in current flowing between the base of the photoreceptor and ground. This is because when the excessive current flowing between the base of the photoreceptor and ground is detected by the current detection means, and the resistance between the base and ground is increased for a predetermined time, and thus excessive current will not flow continuously in the photoreceptor. Therefore, the contact charger in accordance with the present embodiment is always capable of appropriately charging the surface of the photosensitive layer formed on the photoreceptor no matter whether or not a defect exists on the photosensitive layer of the photoreceptor.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A contact charger for uniformly charging a photosensitive layer having a photoconductivity formed on a surface of an electrically conductive base of a photoreceptor, comprising:

charging means for charging the photosensitive layer, said charging means being in contact therewith;

power supply means for supplying voltage to said charging means; and excessive current protection means being connected between the base and a ground for reducing current flowing between the base and ground to substantially none when there is a continuity between the base and said charging means, said excessive current protection means including induced electromotive force generation means having an inductance.

2. The contact charger as set forth in claim 1, wherein said induced electromotive force generation means is a coil.

3. A contact charger for uniformly charging a photosensitive layer having a photoconductivity formed on a surface of an electrically conductive base of a photoreceptor, comprising:

charging means for charging the photosensitive layer, said charging means being in contact therewith;

power supply for applying DC voltage to said charging means; and a coil being connected to the base and ground.

4. The contact charger as set forth in claim 3, wherein said charging means is a charge roller.

5. The contact charger as set forth in claim 4, wherein said charge roller comprises:

a cylindrical roller base made of an electrically conductive material; and an electrically conductive elastic layer formed on a surface of said cylindrical roller base, said electrically conductive elastic layer being in contact with the surface of the photoreceptor with a predetermined nip width.

6. The contact charger as set forth in claim 5, wherein said electrically conductive elastic layer is made of a silicone rubber including a carbon.

7. The contact charger as set forth in claim 3, wherein said charging means is a charge brush.

8. The contact charger as set forth in claim 3, wherein said charging means is a charge blade.

9. A contact charger for uniformly charging a photosensitive layer having a photoconductivity formed on a surface of an electrically conductive base of a photoreceptor, comprising:

charging means for charging the photosensitive layer, said charging means being in contact therewith;

power supply means for supplying voltage to said charging means; and excessive current protection means being connected between the base and a ground for reducing current flowing between the base and ground to substantially none when there is a continuity between the base and said charging means, wherein said excessive current protection means comprises current detection means for detecting current flowing between the base and ground; and resistance change means for increasing an electric resistance between the base and ground for a predetermined time when more than a predetermined amount of current is detected by said current detection means.

10. The contact charger as set forth in claim 9, wherein said resistance change means comprises:

switching signal generation means for outputting a switching signal for a predetermined time when more than a predetermined amount of current is detected by said current detection means; and resistance switch means for switching an electric resistance between the base and ground to be a high resistance only while being inputted the switching signal.

11. The contact charger as set forth in claim 10, wherein said resistance switch means comprises:

a resistance unit having a high resistance;

switching means for selectively switching either connecting the base to ground with or without having said resistance unit in between, said switching means being set so as to connect the base to ground with said resistance unit in between only while the switching signal being inputted thereto.

12. The contact charger as set forth in claim 11, wherein said resistance unit is a resistor.

13. A contact charger for uniformly charging a photosensitive layer having a photoconductivity formed on a surface of an electrically conductive base of a photoreceptor, comprising:

charging means for charging the photosensitive layer, said charging means being in contact therewith;

power supply for applying DC voltage to said charging means;

current detection means for outputting a detecting signal upon detecting more than a predetermined amount of current flowing between the base and ground;

switching signal generation means for outputting a switching signal for a predetermined time upon being inputted the detecting signal;

resistance unit having a high resistance; and a switching circuit with a common terminal being connected to the base, a first contact point being connected to ground with said resistance unit in between and a second contact point being connected to ground without said resistance unit in between, said switching circuit being set so as to connect the common terminal to the second contact point while the switching signal not being inputted, on the other hand, connect the common terminal to the first contact point while the switching signal being inputted.

14. The contact charger as set forth in claim 13, wherein said charging means is a charge roller.

15. The contact charger as set forth in claim 14, wherein said charge roller comprises:

a cylindrical roller base made of an electrically conductive material; and an electrically conductive elastic layer formed on the roller base, said electrically conductive elastic layer being in contact with the surface of the photoreceptor with a predetermined nip width.

16. The contact charger as set forth in claim 15, wherein said electrically conductive elastic layer is made of a silicone rubber including a carbon.

17. The contact charger as set forth in claim 13, wherein said charging means is a charge brush.

18. The contact charger as set forth in claim 13, wherein said charging means is a charge blade.

19. The contact charger as set forth in claim 1, designed for use in an electrophotographic printing machine.

20. The contact charger as set forth in claim 1, designed for use in a photo-copying apparatus.

21. The contact charger as set forth in claim 1, designed for use in a laser printer.

22. The contact charger as set forth in claim 9, designed for use in an electrophotographic printing machine.

23. The contact charger as set forth in claim 9, designed for use in a photo-copying apparatus.

24. The contact charger as set forth in claim 9, designed for use in a laser printer.

* * * * *